US009353707B2

(12) United States Patent
Kimura

(10) Patent No.: US 9,353,707 B2
(45) Date of Patent: May 31, 2016

(54) EVAPORATED FUEL TREATING DEVICE AND FAILURE DETERMINATION METHOD

(71) Applicant: Kenji Kimura, Toyota (JP)

(72) Inventor: Kenji Kimura, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 259 days.

(21) Appl. No.: 14/218,373

(22) Filed: Mar. 18, 2014

(65) Prior Publication Data

US 2014/0283795 A1 Sep. 25, 2014

(30) Foreign Application Priority Data

Mar. 21, 2013 (JP) ..... 2013-057795

(51) Int. Cl.
*F02M 25/08* (2006.01)
*F02B 29/04* (2006.01)

(52) U.S. Cl.
CPC ..... *F02M 25/0809* (2013.01); *F02B 29/0406* (2013.01)

(58) Field of Classification Search
CPC .... F02M 25/08; F02M 25/0809; F02D 41/00; F02D 41/004
See application file for complete search history.

(56) References Cited

U.S. PATENT DOCUMENTS 6,968,732 B2 * 11/2005 Nakoji ..... F02M 25/0809 73/114.38
7,367,326 B2 * 5/2008 Shikama ..... F02M 25/0809 123/198 D
2015/0020780 A1 * 1/2015 Takakura ..... F02M 28/0809 123/520

FOREIGN PATENT DOCUMENTS

JP 2007-023925 A 2/2007
JP 2007-198353 A 8/2007

* cited by examiner

*Primary Examiner* — Hieu T Vo
(74) *Attorney, Agent, or Firm* — Dinsmore & Shohl LLP

(57) ABSTRACT

An evaporated fuel treating device for an engine having an intake pipe, the evaporated fuel treating device includes a fuel evaporation system, a purge valve, a non-return valve, a seal valve mechanism, and an ECU. The system includes a fuel tank, an adsorber, purge passage. The adsorber adsorbs evaporated fuel. The purge valve adjusts a flow rate of the evaporated fuel flowing in the purge passage. The non-return valve prevents a reverse flow of gas in the purge passage from inside of the intake pipe towards the adsorber. The seal valve mechanism seals the system. The ECU configured to (a) open and close the purge valve after causing, the seal valve mechanism to seal the system, when the engine is stopped, and (b) detect an open failure state of the non-return valve based on a pressure difference inside the system when the purge valve is opened and closed.

11 Claims, 4 Drawing Sheets

EVAPORATED FUEL TREATING DEVICE AND FAILURE DETERMINATION METHOD

INCORPORATION BY REFERENCE

The disclosure of Japanese Patent Application No. 2013-057795 filed on Mar. 21, 2013 including the specification, drawings and abstract is incorporated herein by reference in its entirety.

BACKGROUND OF THE INVENTION

1. Field of the Invention

The invention relates to an evaporated fuel treating device.

2. Description of Related Art

There is an evaporated fuel treating device that includes a canister that stores evaporated fuel generated in a fuel tank, a purge passage for supplying the evaporated fuel, which is stored in the canister, to an intake passage, a purge valve that is provided in the purge passage, and controls a supply amount of the evaporated fuel supplied from the canister to the intake passage, and a check valve that includes a valve body and a valve seat in which the valve body is seated. The check valve is provided in the purge passage on the intake passage side of the purge valve. When pressure in the purge passage on the intake passage side is higher than pressure on the canister side, the check valve blocks a flow of air from the intake passage towards the canister by allowing the valve body to be seated in the valve seat (for example, Japanese Patent Application Publication No. 2007-198353 (JP 2007-198353 A)). In JP 2007-198353 A, there is known an evaporated fuel treating device, in which a purge valve is opened for a given open period of time after an engine is stopped, thus preventing a check valve from having a failure due to negative pressure remaining in a purge passage between the purge valve and the check valve.

SUMMARY OF THE INVENTION

In the evaporated fuel treating device described in JP 2007-198353 A, it may be difficult to detect an open failure state. The open failure state is a state where the check valve (herein after, referred to as a "non-return valve") remains opened. The check valve prevents a reverse flow of gas such as air in the purge passage against the canister (herein after, referred to as an "adsorber") from inside of an intake pipe.

The present invention provides an evaporated fuel treating device that is able to detect an open failure state of a non-return valve that prevents a reverse flow of gas in a purge passage against an adsorber from inside of an intake pipe.

In a first aspect of the present invention, an evaporated fuel treating device for an internal combustion engine having an intake pipe, the evaporated fuel treating device includes a fuel evaporation system including a fuel tank, an adsorber, and a purge passage. The fuel tank stores fuel for the internal combustion engine. The adsorber adsorbs evaporated fuel generated in the fuel tank. The purge passage directs a flow of the evaporated fuel, from the adsorber, into the intake pipe of the internal combustion engine. The purge valve adjusts a flow rate of the evaporated fuel flowing in the purge passage. The non-return valve prevents a reverse flow of gas in the purge passage from inside of the intake pipe towards the adsorber. The seal valve mechanism seals the fuel evaporation system. The electronic control unit is configured to open and close the purge valve after causing the seal valve mechanism to seal the fuel evaporation system, when the internal combustion engine is stopped. The electronic control unit is configured to detect an open failure state of the non-return valve based on a pressure difference inside the fuel evaporation system when the purge valve is opened and closed.

With this structure, it is possible to detect the open failure state of the non-return valve that prevents a reverse flow of gas in the purge passage against the adsorber from inside of the intake pipe.

The foregoing evaporated fuel treating device may further include a negative pressure introduction device and a pressure detection device. The negative pressure introduction device may introduce negative pressure into the fuel evaporation system. The pressure detection device may detect a first pressure and a second pressure inside the fuel evaporation system. The pressure detection device may detect the first pressure when the fuel evaporation system is sealed by the seal valve mechanism and negative pressure is introduced into the fuel evaporation system by the negative pressure introduction device. The pressure detection device may detect the second pressure when the purge valve is opened after negative pressure is introduced into the fuel evaporation system by the negative pressure introduction device. The electronic control unit may be configured to detect the open failure state of the non-return valve based on a pressure difference between the first pressure and the second pressure.

With this structure, if the non-return valve is in the open failure state, when the purge valve is opened in the state where negative pressure is introduced into the fuel evaporation system, the non-return valve does not work, and gas is flown into the fuel evaporation system from the inside of the intake pipe. Thus, pressure inside the fuel evaporation system is increased.

On the other hand, if the non-return valve is not in the open failure state, when the purge valve is opened in the state where negative pressure is introduced into the fuel evaporation system, the non-return valve works, and no gas is flown into the fuel evaporation system from the inside of the intake pipe. Thus, pressure inside the fuel evaporation system is hardly increased.

Thus, with this structure, the open failure state of the non-return valve is detected based on a pressure difference between the first pressure inside the fuel evaporation system before the purge valve is opened, and the second pressure after the purge valve is opened.

In the foregoing evaporated fuel treating device, the electronic control unit may be configured to determine that the non-return valve is in the open failure state on condition that the pressure difference, which is obtained by subtracting the first pressure from the second pressure, is equal to or larger than a predetermined threshold.

With this structure, when the non-return valve is in the open failure state, a pressure difference, which is obtained by subtracting the first pressure from the second pressure, becomes equal to or larger than the threshold. Thus, the open failure state of the non-return valve is detected.

The foregoing evaporated fuel treating device may further include a negative pressure introduction device and a pressure detection device. The negative pressure introduction device may introduce negative pressure into the fuel evaporation system. The pressure detection device may detect a first pressure and a second pressure inside the fuel evaporation system. The pressure detection device may detect the first pressure when the fuel evaporation system is sealed by the seal valve mechanism. The pressure detection device may detect the second pressure when the purge valve is opened after the fuel evaporation system space is sealed by the seal valve mechanism, and then negative pressure is introduced into the fuel evaporation system. The electronic control unit may be configured to detect the open failure state of the non-return valve based on a pressure difference between the first pressure and the second pressure.

With this structure, if the non-return valve is in the open failure state, when the purge valve is opened and negative pressure is introduced into the fuel evaporation system, the non-return valve does not work, and gas is flown into the fuel evaporation system space from the inside of the intake pipe. Thus, pressure inside the fuel evaporation system is hardly reduced.

On the other hand, if the non-return valve is not in the open failure state, when the purge valve is opened and negative pressure is introduced into the fuel evaporation system space, the non-return valve works, and no gas is flown into the fuel evaporation system space from the inside of the intake pipe. Thus, pressure inside the fuel evaporation system is reduced.

As stated above, the open failure state of the non-return valve is detected based on a pressure difference between the first pressure and the second pressure. The first pressure is pressure inside the fuel evaporation system before negative pressure is introduced into the fuel evaporation system after the purge valve is opened, and the second pressure is pressure after negative pressure is introduced into the fuel evaporation system.

In the foregoing evaporated fuel treating device, the electronic control unit may be configured to determine that the non-return valve is in the open failure state on condition that the pressure difference, which is obtained by subtracting the second pressure from the first pressure, is less than a predetermined threshold.

With this structure, if the non-return valve is in the open failure state, the pressure difference, which is obtained by subtracting the second pressure from the first pressure becomes less than the threshold. Thus, the open failure state of the non-return valve is detected.

According to a second aspect of the present invention, a failure determination method for an evaporated fuel treating device of an internal combustion engine having an intake pipe, the evaporated fuel treating device having a fuel evaporation system, a purge valve, a non-return valve, and a seal valve mechanism, the fuel evaporation system including a fuel tank, an adsorber, and a purge passage, the fuel tank stores fuel for the internal combustion engine, the adsorber absorbs evaporated fuel generated in the fuel tank, the purge passage directs a flow of the evaporated fuel from the adsorber into the intake pipe of the internal combustion engine, the purge valve adjusts a flow rate of the evaporated fuel flowing in the purge passage, the non-return valve prevents a reverse flow of gas in the purge passage from inside the intake pipe towards the adsorber, the seal valve mechanism seals the fuel evaporation system, the failure determination method includes closing the purge valve when an internal combustion engine is stopped, after the fuel evaporation system is sealed by the seal valve mechanism; detecting a first pressure when the fuel evaporation system is sealed by the seal valve mechanism and the purge valve is closed; opening the purge valve when the internal combustion engine is stopped, after the purge valve is closed and the fuel evaporation system is sealed by the seal valve mechanism; detecting a second pressure when the purge valve is open; and detecting an open failure state of the non-return valve by an electronic control unit based on a pressure difference between the first pressure and the second pressure inside the fuel evaporation system.

According to a third aspect of the present invention, an evaporated fuel treating device for an internal combustion engine having an intake pipe, the evaporated fuel treating device includes a fuel evaporation system, a purge valve, a non-return valve, a seal valve mechanism, a seal valve mechanism and a pressure detection device. The fuel evaporation system includes a fuel tank, an adsorber, and a purge passage. The fuel tank stores fuel for the internal combustion engine. The adsorber adsorbs evaporated fuel generated in the fuel tank. The purge passage directs a flow of the evaporated fuel, from the adsorber, into the intake pipe of the internal combustion engine. The purge valve adjusts a flow rate of the evaporated fuel flowing in the purge passage. The non-return valve prevents a reverse flow of gas in the purge passage from inside of the intake pipe towards the adsorber. The seal valve mechanism seals the fuel evaporation system. The electronic control unit is configured to open and close the purge valve after causing the seal valve mechanism to seal the fuel evaporation system, when the internal combustion engine is stopped. The pressure detection device detects a first pressure and a second pressure inside the fuel evaporation system when the internal combustion engine is stopped. The pressure detection device detects the first pressure when the fuel evaporation system is sealed by the seal valve mechanism and the purge valve is closed, and the pressure detection device detects the second pressure when the purge valve is open. The electronic control unit is configured to detect an open failure state of the non-return valve based on a pressure difference inside the fuel evaporation system when the purge valve is opened and closed.

According to the present invention, it is possible to provide an evaporated fuel treating device that is able to detect an open failure state of a non-return valve that prevents a reverse flow of gas in a purge passage against an adsorber from inside of an intake pipe.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Embodiments of an evaporated fuel treating device according to the present invention will be explained with reference to the drawings.

Figure 1:
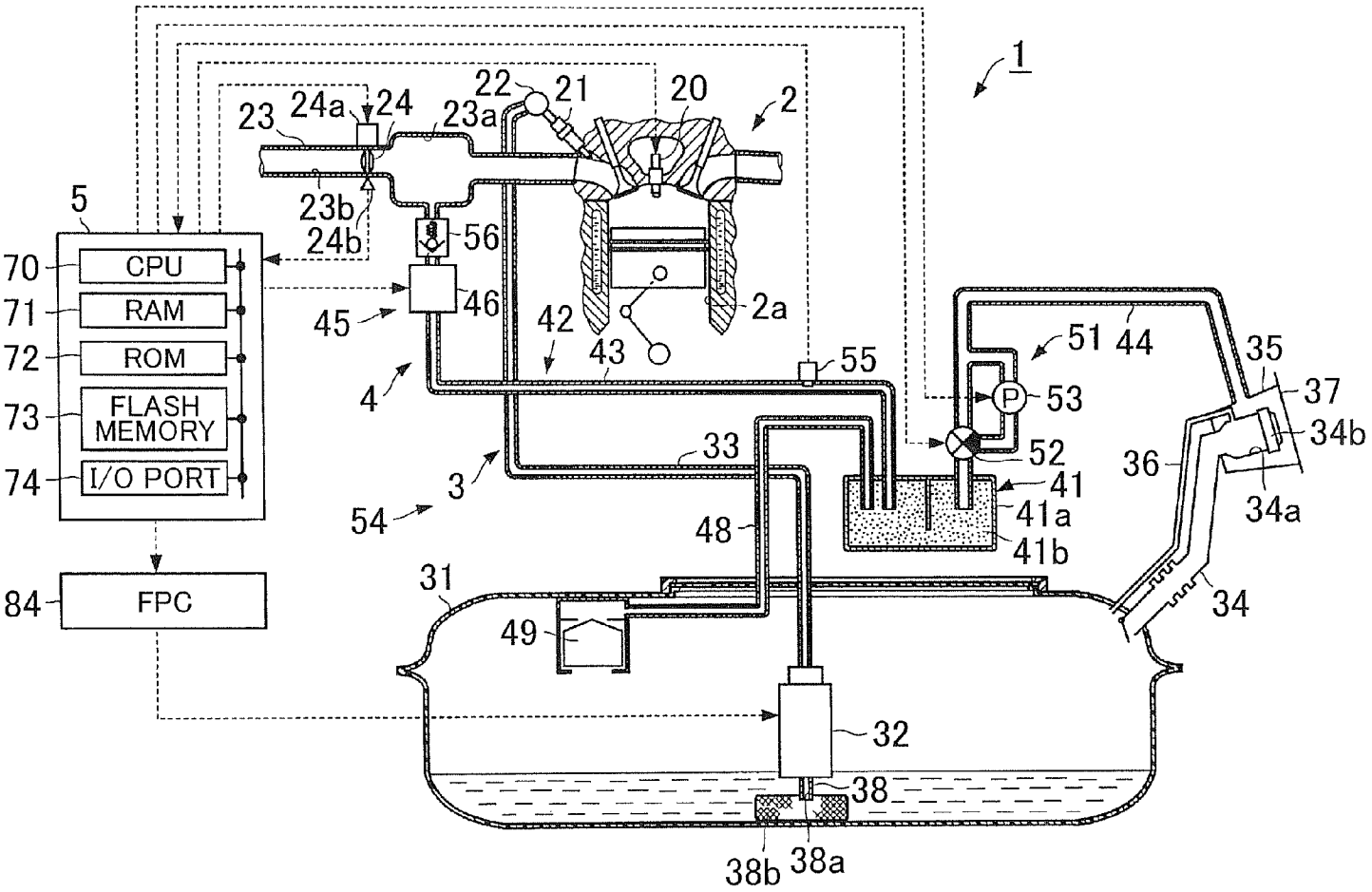
FIG. 1 is a schematic block diagram of a main part including an internal combustion engine for travelling drive, and a fuel system of the internal combustion engine, in a vehicle in which an evaporated fuel treating device according to a first embodiment of the present invention is installed.

A first embodiment will be explained below. FIG. 1 is a structure of a main part of a vehicle in which an evaporated fuel treating device according to the first embodiment of the present invention is installed. This means that FIG. 1 shows mechanisms of an internal combustion engine for traveling drive, and a fuel system that supplies fuel and performs fuel purge for the internal combustion engine. The internal combustion engine according to this embodiment uses highly-volatile fuel, and is installed in a vehicle for traveling drive.

First of all, the structure in this embodiment will be explained.

As shown in FIG. 1, a vehicle 1 according to this embodiment includes an engine 2, a fuel supply mechanism 3, a fuel purge system 4 that structures an evaporated fuel treating device, and an electronic control unit (ECU) 5.

The engine 2 is a spark ignition type multiple cylinder internal combustion engine that uses an ignition plug 20 controlled by the ECU 5. For example, in this embodiment, the engine 2 is structured by an inline four-cylinder engine with four cycles.

Injectors 21 (fuel injection valves) are mounted on intake port parts of four cylinders 2*a* (FIG. 1 shows only one of the cylinders 2*a*) of the engine 2, respectively. The plurality of injectors 21 are connected to delivery pipes 22.

Fuel is pressurized at fuel pressure required by the engine 2, and supplied to the delivery pipes 22 from a later-described fuel pump 32. Highly-volatile fuel is, for example, gasoline.

An intake pipe 23 is connected to an intake port part of the engine 2. The intake pipe 23 is provided with a surge tank 23*a* that has a given capacity for restraining an intake pulsation and intake interference.

The intake pipe 23 includes an intake passage 23*b* inside the intake pipe 23. A throttle valve 24 is provided on the intake passage 23*b*. The throttle valve 24 is driven by a throttle actuator 24*a* so that an opening of the throttle valve 24 is able to be adjusted.

The throttle valve 24 is controlled by ECU 5 and adjusts an opening of the intake passage 23*b*. Thus, an amount of suction air into the engine 2 is adjusted. In the throttle valve 24, a throttle sensor 24*b* is provided, which detects the opening of the throttle valve 24.

The fuel supply mechanism 3 includes a fuel tank 31, a fuel pump 32, a fuel supply pipe 33, and a suction piping 38. The fuel tank 31 stores fuel for the engine 2. The fuel pump 32 pumps up the fuel stored in the fuel tank 31. The fuel supply pipe 33 connects the fuel pump 32 with the delivery pipe 22. The suction piping 38 is provided on an upstream side of the fuel pump 32.

The fuel tank 31 is arranged on a lower side of a vehicle body of the vehicle 1. The fuel tank 31 stores fuel so that the fuel consumed in the engine 2 is able to be replenished. In this embodiment, the fuel pump 32 is housed inside the fuel tank 31.

The fuel pump 32 according to this embodiment is of a discharge performance (a discharge amount and discharge pressure) changeable type, which is able to pump up the fuel inside the fuel tank 31 and pressurize the fuel at given pressure of fuel fed, or higher. For example, the fuel pump 32 is structured by a circumferential flow pump. Although a detailed internal structure of the fuel pump 32 is not shown in the drawing, the fuel pump 32 includes an impeller for operating a pump, and an incorporated motor that drives the impeller.

The fuel pump 32 changes at least either speed of rotation or rotation torque of the impeller that operates the pump, in accordance with a drive voltage and load torque of the incorporated motor. Thus, the fuel pump 32 is able to change discharge performance per unit time.

Since the discharge performance of the fuel pump 32 is changed as stated above, the fuel supply mechanism 3 is provided with a fuel pump controller (FPC) 84 that controls a drive voltage of the fuel pump 32 in accordance with control by the ECU 5.

The fuel supply pipe 33 forms a fuel supply passage that communicates an output port of the fuel pump 32 and the inside of the delivery pipe 22 with each other. The suction piping 38 forms a suction passage 38*a* on an upstream side of the fuel pump 32. In the most upstream part of the suction passage 38*a*, a suction filter 38*b* is provided. The suction filter 38*b* filters fuel to be suctioned into the fuel pump 32.

An oil filler pipe 34 is provided in the fuel tank 31. The oil filler pipe 34 projects so as to extend to a side or the rear of the vehicle 1 from the fuel tank 31. An oil filler port 34*a* is formed in the distal end of the oil filler pipe 34 in the projecting direction of the oil filler pipe 34. The oil filler port 34*a* is housed in a fuel inlet box 35 provided in the body (not shown) of the vehicle 1.

The oil filler pipe 34 is provided with circulation piping 36 that communicates an upper part of the fuel tank 31 and an upstream part of the oil filler pipe 34. In the fuel inlet box 35, a fuel lid 37 is provided, which is open to outside when fueling.

When fuelling, the fuel lid 37 is opened, and a cap 34*b*, which is attached to the oil filler port 34*a* in a detachable manner, is removed. Thus, fuel is able to be fed into the fuel tank 31 from the oil filler port 34*a*.

The fuel purge system 4 is arranged between the fuel tank 31 and the intake pipe 23, to be more specific, between the fuel tank 31 and the surge tank 23*a*. The fuel purge system 4 releases evaporated fuel generated in the fuel tank 31 into the intake passage 23*b* and combusts the evaporated fuel, at the time of intake of the engine 2.

The fuel purge system 4 includes the canister 41, a purge mechanism 42, and a purge control mechanism 45. The canister 41 structures an adsorber that adsorbs evaporated fuel generated in the fuel tank 31. The purge mechanism 42 carries out a purge operation in which purge gas is suctioned into the intake pipe 23 of the engine 2. The purge gas contains air and fuel desorbed from the canister 41 by letting air through the canister 41. The purge control mechanism 45 controls an amount of intake of the purge gas into the intake pipe 23, and prevents an air-fuel ratio in the engine 2 from changing.

In the canister 41, an adsorbent 41*b* such as active carbon is incorporated inside a canister case 41*a*. The canister 41 is set so as to be separated from an inner bottom surface of the fuel tank 31. Inside of the canister 41 (a space where the adsorbent is stored) is communicated with an upper space inside the fuel tank 31 through piping 48 and a gas-liquid separator valve 49.

Therefore, the canister 41 is able to adsorb evaporated fuel by using the adsorbent 41*b* when fuel is evaporated inside the fuel tank 31 and the evaporated fuel gathers in the upper space inside the fuel tank 31. Also, when a liquid level of fuel inside the fuel tank 31 is raised or changed, a gas-liquid separator valve 49 that functions as a non-return valve floats and closes a distal end portion of the piping 48.

The purge mechanism 42 has purge piping 43 and atmosphere piping 44. The purge piping 43 communicates the inside of the canister 41 with inside of the surge tank 23*a* that is included in the intake passage 23*b* of the intake pipe 23. The atmosphere piping 44 releases the inside of the canister 41 to an atmosphere side, for example, to a space at atmospheric-pressure inside the fuel inlet box 35.

In a middle of the atmosphere piping 44, a negative pressure pump module 51 is provided. The negative pressure pump module 51 includes a switching valve 52 and a negative pressure pump 53.

The switching valve 52 takes any one of an atmospheric open state, a negative pressure introduction state, and an atmosphere-blocked state, in accordance with control of the ECU 5. In the atmospheric open state, the switching valve 52 releases the inside of the canister 41 to the atmosphere side through the atmosphere piping 44. In the negative pressure introduction state, the switching valve 52 communicates the inside of the canister 41 with an input port of the negative pressure pump 53. In the atmosphere-blocked state, the switching valve 52 blocks the inside of the canister 41 from the atmosphere side.

The negative pressure pump 53 is structured by an electric pump. The negative pressure pump 53 is driven in accordance with control of the ECU 5. When the switching valve 52 is in the negative pressure introduction state, the negative pressure pump 53 introduces negative pressure into a system space that is formed by the fuel evaporation system 54. The fuel evaporation system 54 includes the fuel tank 31, the canister 41, and the purge piping 43. This way, the negative pressure pump 53 structures a negative pressure introduction part that introduces negative pressure into the fuel evaporation system space (system space).

The fuel evaporation system 54 is provided with a pressure sensor 55 that detects pressure inside the system space. In this embodiment, the pressure sensor 55 is provided in the purge piping 43. The pressure sensor 55 detects pressure of a purge passage formed by the purge piping 43. Thus, the pressure sensor 55 structures a pressure detection part that detects pressure inside the system space.

When the switching valve 52 is in the atmospheric open state, and intake negative pressure is generated inside the surge tank 23*a* while the engine 2 is operated, the purge mechanism 42 introduces intake negative pressure to one end side of the inside of the canister 41 through the purge piping 43, and also introduces atmosphere to the other end side of the inside of the canister 41 through the atmosphere piping 44.

Thus, the purge mechanism 42 desorbs fuel from the canister 41, in which the fuel is adsorbed by the adsorbent 41*b* of the canister 41 and held inside the canister 41. The purge mechanism 42 then suctions the fuel into the surge tank 23*a*.

The purge control mechanism 45 includes a vacuum solenoid valve for purge (herein after, referred to as a "purge VSV") 46 controlled by the ECU 5. The purge VSV 46 is provided in a middle of the purge piping 43. The purge VSV 46 is able to perform variable control of a flow rate of evaporated fuel to be desorbed from the canister 41, by changing opening in the middle of the purge piping 43.

To be specific, opening of the purge VSV 46 is changed as the ECU 5 performs duty control of exciting current of the purge VSV 46. Thus, evaporated fuel desorbed from the canister 41 is able to be suctioned with air into the surge tank 23*a* as purge gas by intake negative pressure inside the intake pipe 23, at a purge rate in accordance with a duty cycle.

By reducing the opening of the purge VSV 46 to zero, the purge VSV 46 structures a seal valve mechanism that seals the system space, in collaboration with the switching valve 52 in the atmosphere-blocked state.

In the purge piping 43, a non-return valve 56 is provided on the surge tank 23*a* side of the purge VSV 46. In the purge passage formed by the purge piping 43, the non-return valve 56 prevents gas such as air from flowing into the canister 41 from inside of the intake pipe 23. To be specific, the non-return valve 56 is structured by a one-way valve that closes when pressure inside the intake pipe 23 is positive pressure, and opens when pressure inside the intake pipe 23 is negative pressure.

Figure 2:
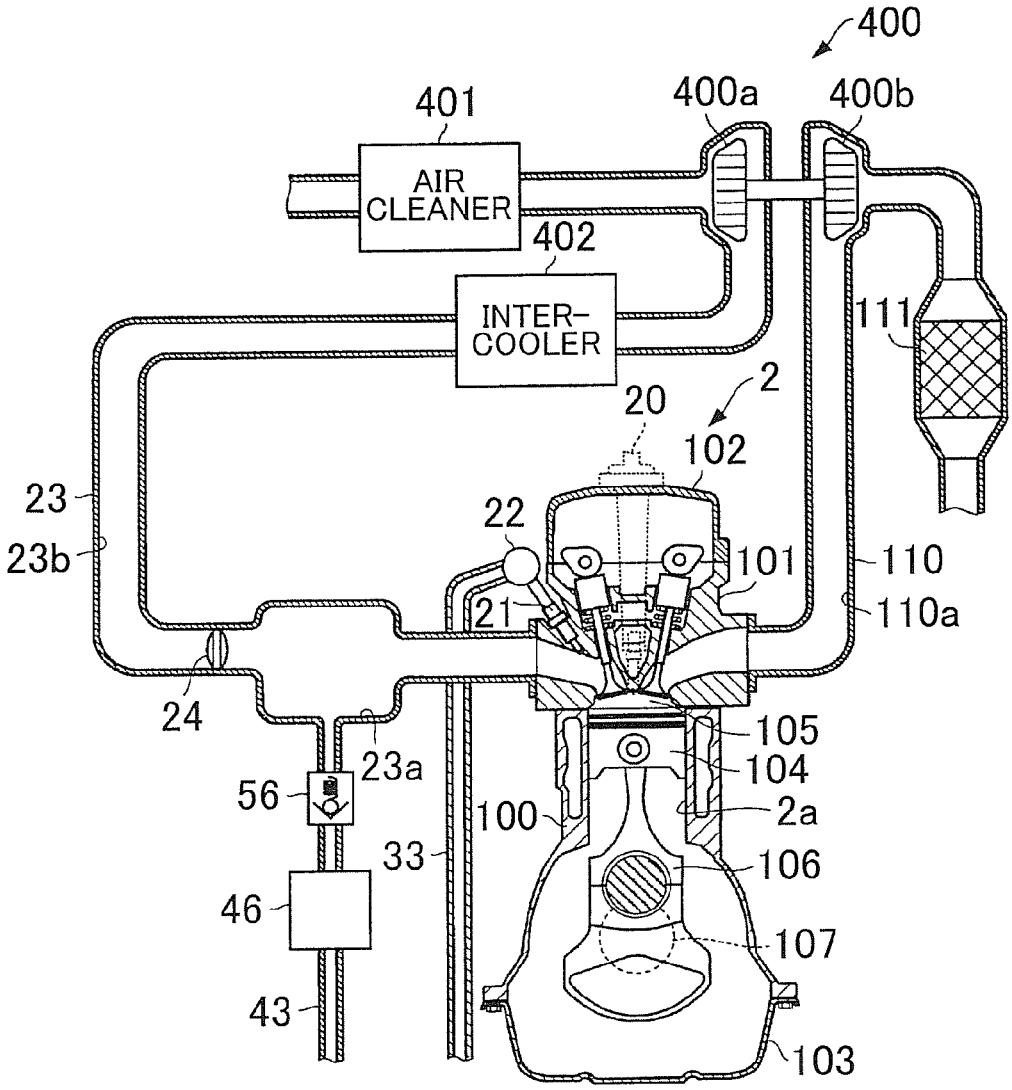
FIG. 2 is a schematic block diagram showing structures of the internal combustion engine for travelling drive and the vicinity of the internal combustion engine in the vehicle in which the evaporated fuel treating device according to the first embodiment of the present invention is installed.

As shown in FIG. 2, the engine 2 is provided with a cylinder block 100, a cylinder head 101, a cylinder head cover 102, and an oil pan 103. The cylinder head 101 is fixed to an upper part of the cylinder block 100. The cylinder head cover 102 covers an upper part of the cylinder head 101. The oil pan 103 is fixed to a lower part of the cylinder block 100 and houses oil. The cylinder block 100 and the cylinder head 101 forms the four cylinders 2*a*.

A piston 104 is housed in the cylinder 2*a* so that the piston 104 is able to have reciprocating motion. The cylinder block 100, the cylinder head 101, and the piston 104 form a combustion chamber 105. The engine 2 is designed to perform a series of four processes including an intake process, a compression process, a combustion process, and an exhaust process, while the piston 104 is reciprocating twice.

The piston 104 housed in the cylinders 2*a* is connected with a crankshaft 107 through a connecting rod 106. The connecting rod 106 converts the reciprocating motion of the piston 104 into rotating motion of the crankshaft 107.

An exhaust pipe 110 is connected with an exhaust port part of the engine 2. An exhaust passage 110*a* formed by the exhaust pipe 110 is provided with a catalyst device 111. The catalyst device 111 is provided with a three-way catalyst that is able to effectively remove substances such as unburned hydrocarbon (HC), carbon monoxide (CO), and nitrogen oxide (NOx) generally contained in exhaust gas. It is preferred that a three-way catalyst is used, which has a function of effectively removing NOx even from exhaust gas with a high content of NOx.

In this embodiment, the engine 2 is provided with a supercharger 400 that is driven by exhaust gas exhausted from the exhaust passage 110*a*. The supercharger 400 is structured so as to send air into the intake passage 23*b*, and has a suction air compressor 400*a* and an exhaust turbine 400*b* that are connected with each other and rotate integrally.

The supercharger 400 rotates the exhaust turbine 400*b* by using exhaust energy of exhaust gas, thus rotating the suction air compressor 400*a*. Thus, it is possible to suction air at positive pressure into the intake pipe 23.

The intake pipe 23 is provided with an air cleaner 401 that cleans suctioned air using a filter on an upstream side of the supercharger 400, and an intercooler 402 that cools suctioned air that is warmed up by supercharging on a downstream side of the supercharger 400. The catalyst device 111 is provided in the exhaust pipe 110 on the downstream side of the supercharger 400.

In FIG. 1, the ECU 5 is structured by a microprocessor including a central processing unit (CPU) 70, a random access memory (RAM) 71, a read only memory (ROM) 72, a flash memory 73, and an input/output port (herein after, referred to as an "I/O port") 74.

A program, which causes the microprocessor to function as the ECU 5, is stored in the ROM 72 of the ECU 5. In other words, as the CPU 70 executes the program stored in the ROM 72 by using the RAM 71 as a working area, the microprocessor functions as the ECU 5.

Various types of sensors including a throttle sensor 24*b* and the pressure sensor 55 are connected to an input side of an I/O port 74 of the ECU 5. Various types of controlled objects such as the ignition plug 20, a throttle actuator 24*a*, the purge VSV 46, the switching valve 52, the negative pressure pump 53, and the FPC 84 are connected to an output side of the I/O port 74 of the ECU 5.

The ECU 5 is able to control the purge rate by performing duty control of the purge VSV 46 based on various types of sensor information. For example, when the engine 2 is in a given operating state, the ECU 5 causes the purge mechanism 42 to execute a purge operation by operating the purge VSV 46 on condition that the opening of the throttle valve 24 obtained from the throttle sensor 24*b* is smaller than opening that is set previously.

In this embodiment, the ECU 5 controls the purge VSV 46 and the switching valve 52 to seal the system space when the engine 2 is stopped. Thereafter, the ECU 5 structures an open failure detecting unit that opens or closes the purge VSV 46 and detects an open failure state of the non-return valve 56 based on a pressure difference when the purge VSV 46 is opened and closed.

To be specific, the ECU 5 determines whether or not the non-return valve 56 is in an open failure state, based on a pressure difference between first pressure P1 and second pressure P2 inside the system space, which are detected by the pressure sensor 55. The first pressure P1 is pressure detected by the pressure sensor 55 when the purge VSV 46 and the switching valve 52 are controlled to seal the system space, and the negative pressure pump 53 is allowed to introduce negative pressure into the system space. The second pressure is pressure detected by the pressure sensor 55 when the purge VSV 46 is opened after the negative pressure pump 53 is allowed to introduce negative pressure into the system space.

More specifically, the ECU 5 determines that the purge VSV 46 is in the open failure state on condition that a pressure difference, which is obtained by subtracting the first pressure P1 from the second pressure P2, is a predetermined threshold TH1 or above. The threshold TH1 is experimentally set in advance in consideration of measurement errors, and is stored in, for example, the ROM 72 of the ECU 5.

Figure 3:
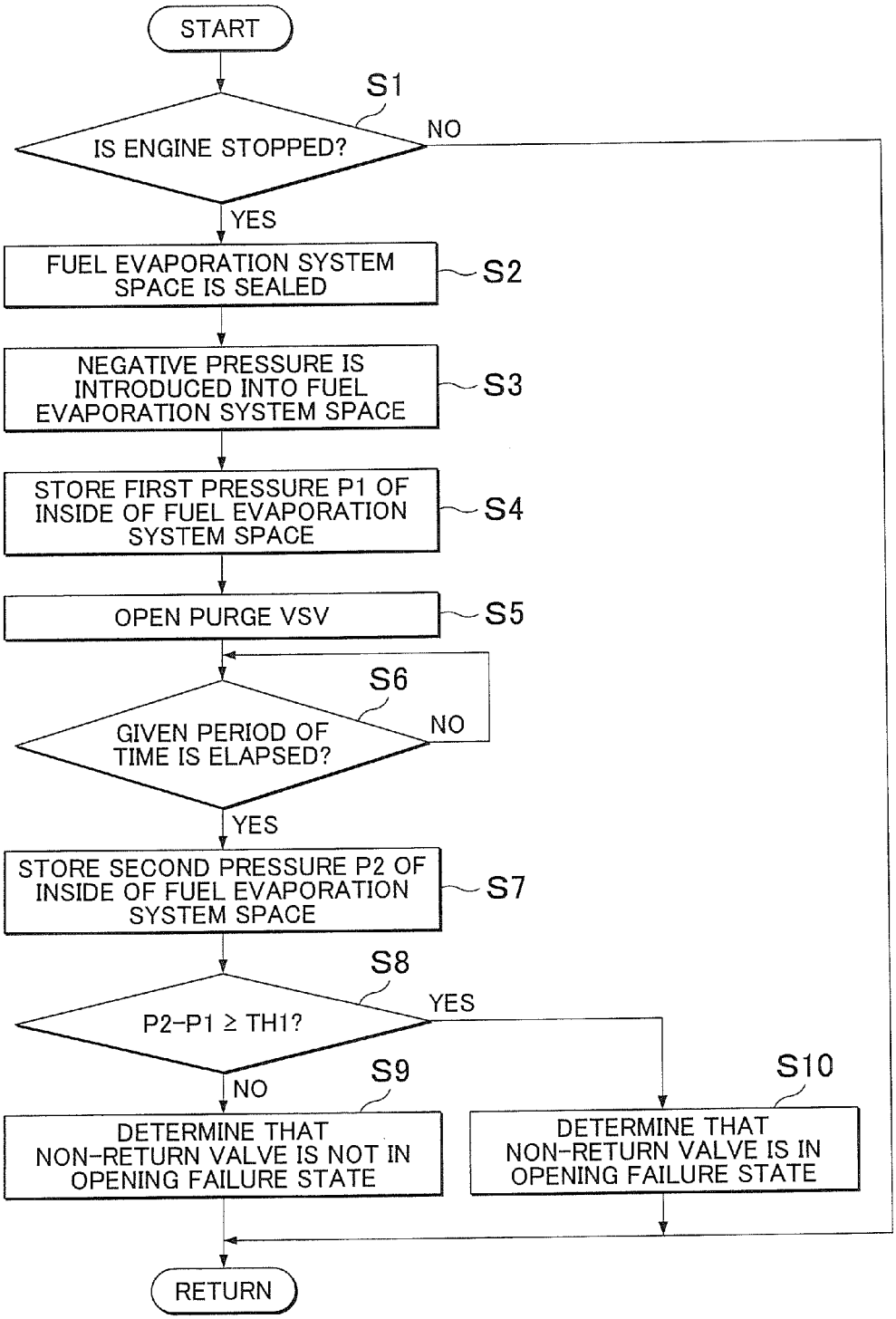
FIG. 3 is a flowchart showing an operation for detecting an open failure of a non-return valve in the evaporated fuel treating device according to the first embodiment of the present invention.

Next, an operation for detecting an open failure in the non-return valve 56 of the evaporated fuel treating device according to this embodiment will be explained with reference to the flowchart shown in FIG. 3. The open failure detecting operation explained below is carried out after a predetermined period of time (for example, a given period of time between about five to seven hours) is elapsed after the engine 2 is stopped.

First, the ECU 5 determines whether or not the engine 2 is stopped (step S1). When the ECU 5 determines that the engine 2 is not stopped (NO in step S1), the ECU 5 ends the open failure detecting operation for the non-return valve 56.

On the other hand, when it is determined that the engine 2 is stopped (YES in step S1), the ECU 5 controls the purge VSV 46 and the switching valve 52 so as to seal the system space that is formed by the fuel evaporation system 54 (herein after, also simply referred to as a "system space") (step S2). Specifically, the ECU 5 closes the purge VSV 46, and switches the switching valve 52 to the atmosphere-blocked state.

Next, the ECU 5 controls the negative pressure pump 53, and introduces negative pressure into the system space (step S3). Specifically, the ECU 5 switches the switching valve 52 to the negative pressure introduction state, and drives the negative pressure pump 53.

Here, the ECU 5 stores the first pressure P1 inside the system space (step S4). To be specific, the ECU 5 stores pressure detected by the pressure sensor 55 as the first pressure P1 in a storage medium such as the RAM 71.

Next, the ECU 5 opens the purge VSV 46 (step S5), and waits for a predetermined period of time to be elapsed until pressure inside the system space is stabilized (step S6).

Next, once the predetermined period of time is elapsed (YES in step S6), the ECU 5 stores the second pressure S2 inside the system space (step S7). Specifically, the ECU 5 stores pressure detected by the pressure sensor 55 as the second pressure P2 in a storage medium such as the RAM 71.

Next, the ECU 5 determines whether or not a pressure difference, which is obtained by subtracting the first pressure P1 from the second pressure P2, is the threshold TH1 or above (step S8). When it is determined that the pressure difference, which is obtained by subtracting the first pressure P1 from the second pressure P2, is not the threshold TH1 or above (NO in step S8), the ECU 5 determines that the non-return valve 56 is not in an open failure state (step S9), stores the determination result in a storage medium such as the flash memory 73, and ends the open failure detecting operation for the non-return valve 56.

On the other hand, when it is determined that the pressure difference, which is obtained by subtracting the first pressure P1 from the second pressure P2, is the threshold TH1 or above (YES in step S8), the ECU 5 determines that the non-return valve 56 is in the open failure state (step S10), stores the determination result in a storage medium such as the flash memory 73, and ends the open failure detecting operation for the non-return valve 56.

As stated above, once the determination result, which is that the non-return valve 56 is in the open failure state, is stored in a storage medium such as the flash memory 73, the ECU 5 notifies that the non-return valve 56 is in the open failure state through a notifying unit such as an instrument panel and a speaker device, after the ignition is turned on.

As explained above, in this embodiment, while the engine 2 is stopped, the purge VSV 46 is opened and closed after the system space is sealed, and the open failure state of the non-return valve 56 is detected based on a pressure difference when the purge VSV 46 is opened and closed. Therefore, it is possible to detect the open failure state of the non-return valve 56 that prevents a reverse flow of gas in the purge passage against the canister 41 from the inside of the intake pipe 23.

In particular, in this embodiment, if the non-return valve 56 is in the open failure state, when the purge VSV 46 is opened when negative pressure is introduced in the system space, the non-return valve 56 does not work and gas is flown into the system space from the inside of the intake pipe 23. Thus, pressure in the system space is increased.

On the other hand, if the non-return valve 56 is not in the open failure state, when the purge VSV 46 is opened when negative pressure is introduced in the system space, the non-return valve 56 works and no gas is flown into the system space from the inside of the intake pipe 23. Thus, pressure in the system space is hardly increased.

As stated above, in this embodiment, it is possible to detect the open failure state of the non-return valve 56 based on a pressure difference between the first pressure P1 inside the system space before the purge VSV 46 is opened, and the second pressure P2 after the purge VSV 46 is opened.

In this embodiment, it was explained that the fuel pump 32 is housed inside the fuel tank 31. However, as other embodiment of the present invention, the fuel pump 32 may be provided outside the fuel tank 31.

In this embodiment, it was explained that the canister 41 is provided outside the fuel tank 31. However, as other embodiment of the present invention, the canister 41 may be housed inside the fuel tank 31.

In this embodiment, it was explained that the switching valve 52 takes any one of the atmospheric open state, the negative pressure introduction state, and the atmosphere-blocked state. However, the present invention is not limited to this, and the switching valve 52 may take either the atmospheric open state or the negative pressure introduction state, and the negative pressure introduction state may be taken for the atmosphere-blocked state, as long as a non-return valve is provided inside the negative pressure pump 53.

In this embodiment, the example was explained, in which the pressure sensor 55 is provided in the purge piping 43. However, the present invention is not limited to this, and it is only required that the pressure sensor 55 is provided so as to be able to detect pressure inside the system space. For example, the pressure sensor 55 may be provided so as to detect pressure in the fuel tank 31 or the canister 41.

In this embodiment, the example was explained, in which the negative pressure pump module 51 is provided in the middle of the atmosphere piping 44, and negative pressure is introduced into the system space by the negative pressure pump 53 that structures the negative pressure pump module 51. However, the present invention is not limited to this, and it is only required that the negative pressure pump 53 is provided so as to be able to introduce negative pressure into the system space. For example, the negative pressure pump 53 may be provided in the fuel tank 31 or in the canister 41, on a downstream side of the purge VSV 46 of the purge piping 43, or in the piping 48.

In this embodiment, the example was explained, in which the evaporated fuel treating device according to the present invention is applied to the engine 2 having the supercharger 400 that sends air to the intake passage 23*b* by using exhaust gas exhausted from the exhaust passage 110*a*.

However, the evaporated fuel treating device according to the present invention may be applied to the engine 2 having a supercharger that rotates the suction air compressor 400*a* by using rotation of the crankshaft 107, or to the engine 2 that does not have a supercharger.

Next, a second embodiment of the present invention will be explained below. In this embodiment, differences from the first embodiment of the present invention will be explained. Constituents of this embodiment, which are similar to those of the first embodiment of the present invention, will be denoted by the same reference numerals, and differences will be explained.

In this embodiment, a ROM 72 in an ECU 5 stores a program that is different from the program stored in the ROM 72 in the ECU 5 in the first embodiment of the present invention. Thus, functions of the ECU 5 in this embodiment are changed as explained below from the functions of the ECU 5 according to the first embodiment of the present invention.

The ECU 5 determines whether or not a non-return valve 56 is in an open failure state, based on a pressure difference between first pressure P1 and second pressure P2 inside a system space, which are detected by a pressure sensor 55. The first pressure P1 in this embodiment is pressure detected when a purge VSV 46 and a switching valve 52 are controlled to seal the system space. The second pressure P2 is pressure detected when the purge VSV 46 is opened after the system space is sealed, and negative pressure is introduced into the system space by a negative pressure pump 53.

To be specific, the ECU 5 determines that the purge VSV 46 is in the open failure state on condition that a pressure difference, which is obtained by subtracting the second pressure P2 from the first pressure P1, is smaller than a predetermined threshold TH2. The threshold TH2 is determined experimentally in advance in consideration of measurement errors, and stored in the ROM 72 in the ECU 5.

Figure 4:
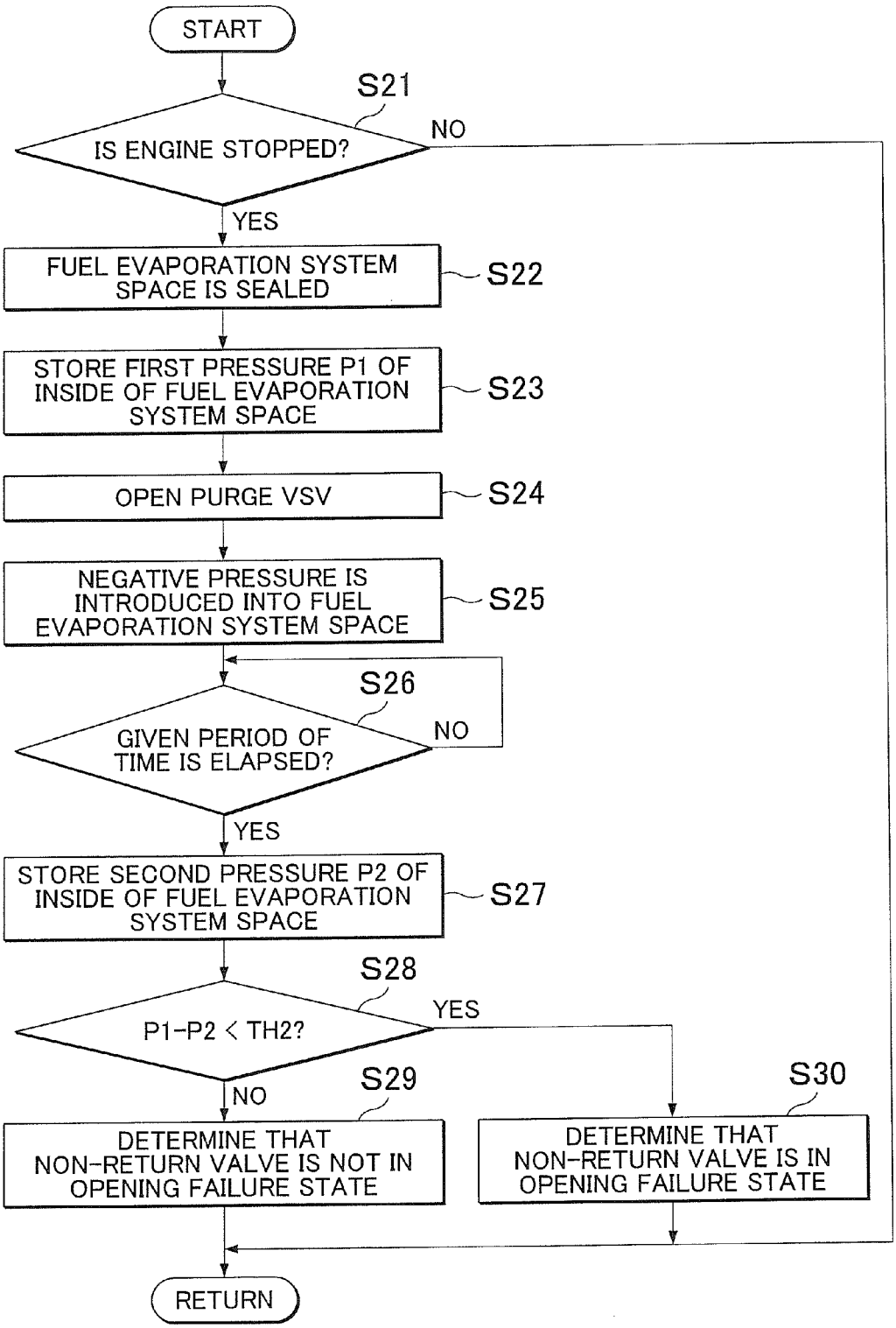
FIG. 4 is a flowchart showing an operation for detecting an open failure of a non-return valve in an evaporated fuel treating device according to a second embodiment of the present invention.

Next, an open failure detecting operation for the non-return valve 56 of the evaporated fuel treating device according to this embodiment will be explained with reference to the flowchart shown in FIG. 4. The open failure detecting operation for the non-return valve 56 is carried out once a predetermined period of time (for example, a given period of time from about five to seven hours) is elapsed after the engine 2 is stopped.

First of all, the ECU 5 determines whether or not the engine 2 is stopped (step S21). When it is determined that the engine 2 is not stopped (NO in step S21), the ECU 5 ends the open failure detecting operation for the non-return valve 56.

On the other hand, when it is determined that the engine 2 is stopped (YES in step S21), the ECU 5 controls the purge VSV 46 and the switching valve 52 so as to seal the system space (step S22). To be specific, the ECU 5 closes the purge VSV 46, and switches the switching valve 52 to an atmosphere-blocked state.

The ECU 5 stores the first pressure P1 inside the system space (step S23). To be specific, the ECU 5 stores pressure detected by the pressure sensor 55 as the first pressure P1 in a storage medium such as a RAM 71.

Next, the ECU 5 opens the purge VSV (step S24), and controls the negative pressure pump 53 so as to introduce negative pressure into the system space (step S25). To be specific, the ECU 5 switches the switching valve 52 to a negative pressure introduction state, and drives the negative pressure pump 53.

Next, the ECU 5 waits for a predetermined period of time to be elapsed until pressure inside the system space is stabilized (step S26). Once the predetermined period of time is elapsed (YES in step S26), the ECU 5 stores the second pressure P2 inside the system space (step S27). Specifically, the ECU 5 stores pressure detected by the pressure sensor 55 as the second pressure P2 in a storage medium such as the RAM 71.

Then, the ECU 5 determines whether or not a pressure difference, which is obtained by subtracting the second pressure P2 from the first pressure P1, is less than a threshold TH2 (step S28). When it is determined that the pressure difference, which is obtained by subtracting the second pressure P2 from the first pressure P1, is not less than the threshold TH2 (NO in step S28), the ECU 5 determines that the non-return valve 56 is not in the open failure state (step S29), stores the determination result in a storage medium such as a flash memory 73, and ends the open failure detecting operation for the non-return valve 56.

On the other hand, when it is determined that the pressure difference, which is obtained by subtracting the second pressure P2 from the first pressure P1, is less than threshold TH2 (YES in step S28), the ECU 5 determines that the non-return valve 56 is in the open failure state (step S30), stores the determination result in a storage medium such as the flash memory 73, and ends the open failure detecting operation for the non-return valve 56.

As stated above, when the determination result that the non-return valve 56 is in the open failure state is stored in a storage medium such as the flash memory 73, the ECU 5 notifies that the non-return valve 56 is in the open failure state through a notifying unit such as an instrument panel or a speaker device, after, for example, the ignition is turned on.

As explained so far, in this embodiment, it is possible to obtain the same effects as those in the first embodiment of the present invention.

In particular, in this embodiment, if the non-return valve 56 is in the open failure state, when the purge VSV 46 is opened and negative pressure is introduced into the system space, non-return valve 56 does not work and gas is flown into the system space from the inside of the intake pipe 23. Thus, pressure inside the system space is hardly reduced.

On the other hand, if the non-return valve 56 is not in the open failure state, when the purge VSV 46 is opened and negative pressure is introduced into the system space, the non-return valve 56 works, and no gas is flown into the system space from the inside of the intake pipe 23. Thus, pressure inside the system space is reduced.

In this way, this embodiment is able to detect the open failure state of the non-return valve 56 based on the pressure difference between the first pressure P1 inside the system space before the purge VSV 46 is opened, and the second pressure P2 after the purge VSV 46 is opened.

As stated so far, the evaporated fuel treating device according to the present invention has an effect that it is possible to detect the open failure state of the non-return valve that prevents a reverse flow of gas in the purge passage against the adsorber from the inside of the intake pipe. The evaporated fuel treating device is particularly useful as an evaporated fuel treating device to be applied to an internal combustion engine having a supercharger.

Although the present invention has been explained with reference to the embodiments, the present invention is not limited to the above-mentioned embodiments and structures. The present invention may have configurations variously modified from or equivalent to the above-mentioned embodiments and structures. Configurations with limited constituents of various sorts stated in the embodiments, and various combinations of such configurations are included in the scope of the present invention.

What is claimed is:

1. An evaporated fuel treating device for an internal combustion engine having an intake pipe, the evaporated fuel treating device comprising:

a fuel evaporation system including a fuel tank, an adsorber, and a purge passage, the fuel tank that stores fuel for the internal combustion engine, the adsorber that adsorbs evaporated fuel generated in the fuel tank, the purge passage that directs a flow of the evaporated fuel, from the adsorber, into the intake pipe of the internal combustion engine;

a purge valve that adjusts a flow rate of the evaporated fuel flowing in the purge passage;

a non-return valve that prevents a reverse flow of gas in the purge passage from inside of the intake pipe towards the adsorber;

a seal valve mechanism that seals the fuel evaporation system; and an electronic control unit configured to open and close the purge valve after causing the seal valve mechanism to seal the fuel evaporation system, when the internal combustion engine is stopped, and the electronic control unit configured to detect an open failure state of the non-return valve based on a pressure difference inside the fuel evaporation system when the purge valve is opened and closed.

2. The evaporated fuel treating device according to claim 1, further comprising:

a negative pressure introduction device that introduces negative pressure into the fuel evaporation system; and a pressure detection device that detects a first pressure and a second pressure inside the fuel evaporation system, wherein the pressure detection device detects the first pressure when the fuel evaporation system is sealed by the seal valve mechanism and negative pressure is introduced into the fuel evaporation system by the negative pressure introduction device, and the pressure detection device detects the second pressure when the purge valve is opened after negative pressure is introduced into the fuel evaporation system by the negative pressure introduction device, wherein the electronic control unit is configured to detect the open failure state of the non-return valve based on a pressure difference between the first pressure and the second pressure.

3. The evaporated fuel treating device according to claim 2, wherein the electronic control unit is configured to determine that the non-return valve is in the open failure state on condition that the pressure difference, which is obtained by subtracting the first pressure from the second pressure, is equal to or larger than a predetermined threshold.

4. The evaporated fuel treating device according to claim 1, further comprising:

a negative pressure introduction device that introduces negative pressure into the fuel evaporation system; and a pressure detection device that detects a first pressure and a second pressure inside the fuel evaporation system, wherein the pressure detection device detects the first pressure when the fuel evaporation system is sealed by the seal valve mechanism, and wherein the pressure detection device detects the second pressure when the purge valve is opened after the fuel evaporation system is sealed by the seal valve mechanism, and then negative pressure is introduced into a fuel evaporation system space, wherein the electronic control unit is configured to detect the open failure state of the non-return valve based on a pressure difference between the first pressure and the second pressure.

5. The evaporated fuel treating device according to claim 4, wherein the electronic control unit is configured to determine that the non-return valve is in the open failure state on condition that the pressure difference, which is obtained by subtracting the second pressure from the first pressure, is less than a predetermined threshold.

6. A failure determination method for an evaporated fuel treating device of an internal combustion engine having an intake pipe, the evaporated fuel treating device having a fuel evaporation system, a purge valve, a non-return valve, and a seal valve mechanism, the fuel evaporation system including a fuel tank, an adsorber, and a purge passage, the fuel tank stores fuel for the internal combustion engine, the adsorber absorbs evaporated fuel generated in the fuel tank, the purge passage directs a flow of the evaporated fuel from the adsorber into the intake pipe of the internal combustion engine, the purge valve adjusts a flow rate of the evaporated fuel flowing in the purge passage, the non-return valve prevents a reverse flow of gas in the purge passage from inside the intake pipe towards the adsorber, the seal valve mechanism seals the fuel evaporation system, the failure determination method comprising:

closing the purge valve when the internal combustion engine is stopped, after the fuel evaporation system is sealed by the seal valve mechanism;

detecting a first pressure when the fuel evaporation system is sealed by the seal valve mechanism and the purge valve is closed;

opening the purge valve when the internal combustion engine is stopped, after the purge valve is closed and the fuel evaporation system is sealed by the seal valve mechanism;

detecting a second pressure when the purge valve is open; and detecting an open failure state of the non-return valve by an electronic control unit based on a pressure difference between the first pressure and the second pressure inside the fuel evaporation system.

7. The failure determination method according to claim 6, wherein the first pressure is detected when the fuel evaporation system is sealed by the seal valve mechanism and negative pressure is introduced into the fuel evaporation system by a negative pressure introduction device, and the second pressure is detected when the purge valve is open after negative pressure is introduced into the fuel evaporation system by the negative pressure introduction device.

8. The failure determination method according to claim 7, wherein the open failure state of the non-return valve is determined on a condition that the pressure difference, which is obtained by subtracting the first pressure from the second pressure, is equal to or larger than a predetermined threshold.

9. The failure determination method according to claim 6, wherein the first pressure is detected when the fuel evaporation system is sealed by the seal valve mechanism, and the second pressure is detected when the purge valve is opened after the fuel evaporation system is sealed by the seal valve mechanism, and then negative pressure is introduced into the fuel evaporation system.

10. The failure determination method according to claim 9, wherein the open failure state of the non-return valve is determined on a condition that the pressure difference, which is obtained by subtracting the second pressure from the first pressure, is less than a predetermined threshold.

11. An evaporated fuel treating device for an internal combustion engine having an intake pipe, the evaporated fuel treating device comprising:

a fuel evaporation system including a fuel tank, an adsorber, and a purge passage, the fuel tank that stores fuel for the internal combustion engine, the adsorber that adsorbs evaporated fuel generated in the fuel tank, the purge passage that directs a flow of the evaporated fuel, from the adsorber, into the intake pipe of the internal combustion engine;

a purge valve that adjusts a flow rate of the evaporated fuel flowing in the purge passage;

a non-return valve that prevents a reverse flow of gas in the purge passage from inside of the intake pipe towards the adsorber;

a seal valve mechanism that seals the fuel evaporation system;

an electronic control unit configured to open and close the purge valve after causing the seal valve mechanism to seal the fuel evaporation system, when the internal combustion engine is stopped; and a pressure detection device that detects a first pressure and a second pressure inside the fuel evaporation system when the internal combustion engine is stopped, the pressure detection device detects the first pressure when the fuel evaporation system is sealed by the seal valve mechanism and the purge valve is closed, and the pressure detection device detects the second pressure when the purge valve is open, the electronic control unit configured to detect an open failure state of the non-return valve based on a pressure difference between the first pressure and the second pressure.

* * * * *